US008322886B1

(12) United States Patent
Bowser

(10) Patent No.: US 8,322,886 B1
(45) Date of Patent: Dec. 4, 2012

(54) LIGHTING TUBE FITTING

(76) Inventor: Roger C. Bowser, Mesa, AZ (US)

( * ) Notice: Subject to any disclaimer, the term of this patent is extended or adjusted under 35 U.S.C. 154(b) by 352 days.

(21) Appl. No.: 12/816,980

(22) Filed: Jun. 16, 2010

Related U.S. Application Data

(60) Provisional application No. 61/187,377, filed on Jun. 16, 2009.

(51) Int. Cl.
*F21V 33/00* (2006.01)

(52) U.S. Cl. ..... 362/263; 362/261

(58) Field of Classification Search ..... 362/261, 362/262, 263
See application file for complete search history.

(56) References Cited

U.S. PATENT DOCUMENTS

| | | | | |
|---|---|---|---|---|
| 2,343,691 | A | 3/1944 | Miller | |
| 3,011,744 | A | 12/1951 | Morgan, Jr. | |
| 4,428,039 | A | 1/1984 | Gulmond et al. | |
| 4,666,109 | A | 5/1987 | Fallon et al. | |
| 4,842,535 | A | 6/1989 | Velke, Sr. et al. | |
| 5,216,318 | A * | 6/1993 | Van Dulmen et al. | 313/49 |
| 5,291,092 | A | 3/1994 | Coushaine | |
| 5,797,675 | A | 8/1998 | Tanner, Jr. | |
| 7,219,931 | B2 | 5/2007 | Kato | |
| 2009/0072742 | A1 * | 3/2009 | Lin | 313/623 |

FOREIGN PATENT DOCUMENTS

| | | |
|---|---|---|
| JP | 2006260893 | 9/2006 |

* cited by examiner

*Primary Examiner* — Laura Tso
(74) *Attorney, Agent, or Firm* — Booth Udall, PLC

(57) ABSTRACT

A lighting tube fitting apparatus, method and system that allows movement of a lighting tube about two axes while preventing rotation about the longitudinal axis of the lighting tube it. A lighting tube within one of the disclosed fittings provides greater ability to align the electrode ends of a lighting tube with electrode holders. This reduces the need for the tight tolerances that are typically required in the art of conventional tube lighting. The movement of the lighting tube is enabled in the disclosed implementation using one or more pressure arcs within a clamp body make contact with a clamp ring that holds a lighting tube in place and prevents its rotation about its own axis. The lighting tube fittings provide the additional benefit of supporting the entire weight and position of the lighting tube, eliminating the need for any additional lighting tube supports along the length of the lighting tube.

26 Claims, 4 Drawing Sheets

LIGHTING TUBE FITTING

CROSS REFERENCE TO RELATED APPLICATIONS

This Application claims the benefit of the filing date of U.S. Provisional Patent Application 61/187,377 to Roger C. Bowser entitled "Lighting Tube Fitting," which was filed on Jun. 16, 2009, the disclosure of which is hereby incorporated herein by reference.

BACKGROUND

1. Technical Field

This disclosure relates to lighting tube fittings and structures with specific application to custom made lighting tube holding devices.

2. Background Art

Holders for lighting tubes are known in the art. For example, various conventional fittings for holding neon tubes are illustrated and described in U.S. Pat. No. 4,947,301 to Charles Steele, entitled "Neon Tube Electrode Housing," issued Aug. 7, 1990, the disclosure of which is hereby incorporated by reference.

Gas filled lighting tubes (tubes) became popular as the well known neon advertisement signs and have evolved into the familiar fluorescent tubes of standard lengths used in businesses and homes ubiquitously. These tubes are typically designed with two electrodes at each end and standard electrical fittings and plugs have been designed to facilitate the use of these tubes everywhere. Although gas filled lighting has been standardized in many aspects, custom lighting tubes still exists. Custom made lighting tubes continue to be used for advertisement and other target locations in a home or business where unique lighting is desired. These custom made lighting tubes typically include the standard two prong electrodes at each end of the tube connected to a power source that subsequently ionizes a gas within the tube to create luminescence.

One of the principle challenges of installing custom made lighting tubes in a sign or for other use is mounting of the lighting tubes on a fascia or within lighting housing. Each tube is generally a piece of custom glass work and the tube is formed in a particular shape with the electrodes of the tube designed for a targeted dimension to correspond with and be parallel with each other. The custom glass work, however, because each tube is manufactured separately, does not always align properly with the electrode holders and there exists the potential for the tube electrodes to not align properly with sign housing fixtures.

Because of the specific tolerances that must generally be met for a tube to attach to a conventional sign, it is not uncommon for the electrode ends to not be exactly parallel. Where a replacement lighting tube is manufactured to fit an existing lighting display, the alignment with both the electrode holders and with the existing tube supports may be desired but is difficult to achieve. The new lighting tube will often break during the installation process as an installer attempts to align the rigid glass tube into an existing support. In addition, once conventional tubes are installed in a sign, the tube is generally quite rigidly fixed in place, and there can be little or no adjustment of the positions of the electrodes. Because of this, an installer generally cannot perform any, or can only perform very few, adjustments of the electrode positions of the tube after installation to adapt to particular tube holders. Also, because the tube is rigidly fixed, thermal expansion stresses on the tube during seasonal operation can be significant, particularly if the electrode was installed touching one of the surfaces of the housing. In addition, because the tube supports are located along the surface of the sign, conventional tubes are manufactured to produce shapes within a single plane that is parallel with a back wall of the sign housing, allowing them to be within reach of the tube supports.

SUMMARY

The foregoing and other aspects, features, and advantages will be apparent to those artisans of ordinary skill in the art from the DESCRIPTION and DRAWINGS, and from the CLAIMS.

Implementations of lighting tube (tube) fittings are disclosed that hold a tube at the electrode ends and prevents movement of the tube relative to a central axis of the fitting and rotation, while permitting non-axial movement of the tube. Particular implementations of tube fittings disclosed in this document may provide the entire support of a tube at its electrode ends, and may not require the use of any additional tube supports along the length of the tube or face of the sign. In addition, tubes containing shapes out of a single plane of the sign may be utilized, as a result of the support of the tubes being provided at the tube ends. A wide variety of implementations of tube fittings are disclosed.

Implementations of a lighting tube fitting are disclosed for connecting and securing lighting tubes at their electrode ends to a fascia or other display housing. The lighting tube fitting includes a clamp body, at least one pressure arc and a clamp ring. The clamp body includes a side wall, a first and second end opening and at least two apertures. The pressure arc has a concave inner surface and an outer surface with at least two protrusions that are able to fit through the apertures in the clamp body. These protrusions may be rounded or dome shaped or may be any other geometric shape. The clamp ring has an inner diameter sufficiently large to receive an end of the clamp body. When a lighting tube is assembled with the clamp body, the protrusions of the pressure arcs extend through the apertures of the clamp body to contact and exert a force on the inner walls of the clamp ring. The lighting tube may fit in one opening end of the clamp body that has an inner diameter greater than 6 mm and may also include a threaded outer surface.

The clamp ring may also include protrusion grooves on the inner surface that align with the protrusions of the pressure rings and that permit rotation of the clamp ring with respect to the clamp body as the protrusions are maintained within the grooves. The outer surface of the clamp body or protrusions may be convex, but this is not necessary as long as the clamp ring is able to rotate about the outer surface of the clamp body. These protrusion grooves may have a slope that decreases in depth from the inner surface of the clamp ring and as it extends around the inner circumference of the clamp ring. The width of the protrusion grooves on the inner diameter of the clamp ring is greater than the width of the respective protrusions. Other grooves on the inner surface of the clamp ring may align with an angled flange on the outer surface of the clamp body and may include at least one angled groove wall to further engage the clamp ring to the clamp body.

Other implementations of the light tube fitting may use two or three pressure arcs instead of a single arc and each of the two or three arcs may have a protrusion that fits through a corresponding aperture in the clamp body. The protrusions may also be compressible with respect to the arcs themselves. Additionally, when assembled with a lighting tube, a tubular sleeve may be placed around the lighting tube or a coating may be included on the concave side of the pressure arcs before they are placed around the lighting tube. Furthermore, a relief sleeve may be coupled to the clamp ring at the electrode end of the lighting tube.

Another implementation disclosed is a method for securing and supporting a lighting tube by passing the electrode end of a lighting tube through an aperture to the first side of a fascia and placing a clamp body with at least one pressure arc inside the clamp body around the lighting tube. At least two protrusions extend from the surface of the pressure arc through apertures in the side wall of the clamp body. The first end of the clamp body slides back through the aperture in the fascia such that a majority of the clamp body is on a first side of the fascia and the first end of the clamp body extends through to the opposing side of the fascia.

A clamp ring slides around a first end of the clamp body and engages the clamp body by exerting a force against the at least two protrusions of the pressure arcs and on end of the clamp body is received in the clamp ring. This then exerts a force against the lighting tube within the pressure arc. The first end of the clamp body is secured to the fascia by coupling a fastener to the first end of the clamp body on the second side of the fascia. The clamp ring may include grooves that align and engage the protrusions extending through the apertures of the clamp body and allow rotation of the clamp ring about the clamp body as the protrusions are maintained in the grooves of the clamp ring.

After engaging the clamp ring with the clamp body and after securing the first end of the clamp body to the second side of the fascia, the adjusting of the lighting tube about at least one axis, but not more than two, is possible. Once the adjustments of the lighting tube are made for the first electrode end of the lighting tube, a second electrode end of the lighting tube may be secured with a second clamp body, pressure arc, and clamp ring in the same manner as the first electrode end of the lighting tube.

A lighting tube display system is also disclosed that includes a lighting tube with an electrode end that is secured to a display housing through an electrode port by the disclosed lighting tube fitting. The lighting tube fitting prevents the lighting tube from rotating about the longitudinal axis of the first electrode end but allows rotation about a second axis perpendicular to the longitudinal axis. It may also allow rotation about a third axis that is perpendicular to both the longitudinal axis and the second axis. This rotation may be limited to less than 4 degrees.

A second lighting tube fitting attached to a second electrode end of the lighting tube at a second electrode port of the display housing will secure the lighting tube to the display housing and prevent the lighting tube from rotating about any axis. Once the lighting tube is fixed at both electrode ends at the electrode ports of the display housing, the two lighting tube fittings will support the entire weight of the lighting tube. This eliminates the need for any additional supports along the length of the lighting tube within the display housing and allows a lighting tube to be designed beyond a single plane.

BRIEF DESCRIPTION OF THE DRAWINGS

The foregoing and other aspects, features, and advantages will be apparent to those artisans of ordinary skill in the art from the DESCRIPTION and DRAWINGS, and from the CLAIMS.

A more complete understanding of the disclosure may be derived by referring to the detailed description when considered in connection with the following illustrative figures. In the figures, like reference numbers refer to like elements or acts throughout the figures.

DESCRIPTION

In the following description, and for the purposes of explanation, numerous specific details are set forth in order to provide a thorough understanding of the various aspects of the inventions disclosed herein. It will be understood, however, by those skilled in the relevant arts, that the principles learned from this disclosure may be practiced by those of ordinary skill in the art without these specific details. In other instances, known structures and devices are shown or discussed more generally in order to avoid obscuring more pertinent features. In many cases, a description of the operation is sufficient to enable one to implement the various forms of the devices and methods. It should be noted that there are many different and alternative configurations, devices and technologies to which the disclosure may be applied. The full scope of the inventions is not limited to the examples that are described below.

Figure 1:
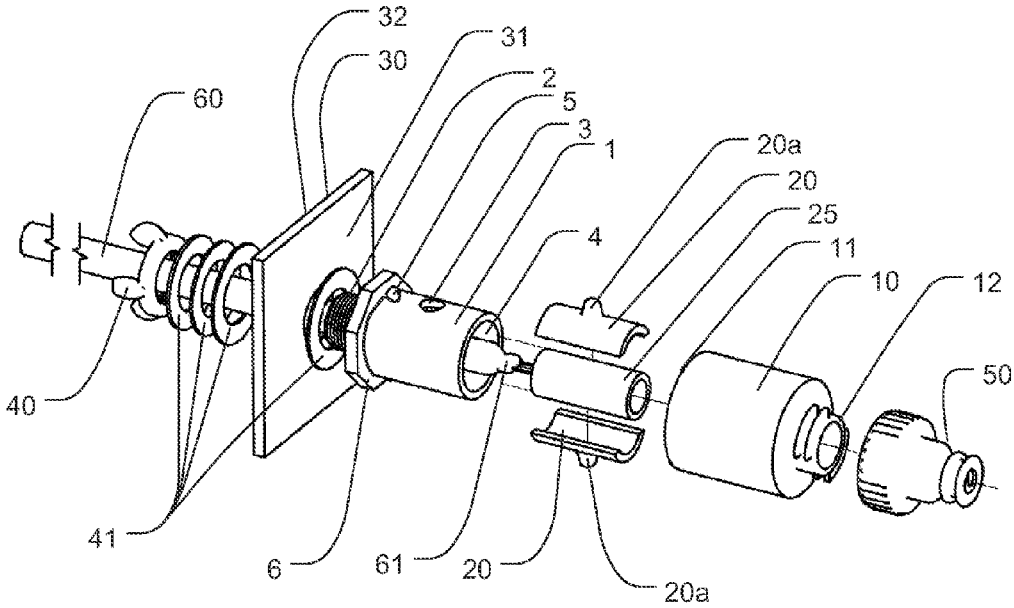
FIG. 1 illustrate an exploded view of a lighting tube fitting.

One particular implementation of a lighting tube fitting that includes various elements is illustrated in FIGS. 1-6 as a non-limiting example of the principles disclosed and discussed herein to describe other implementations. Referring specifically to FIG. 1, an exploded view of a lighting tube fitting with a clamp body 1 includes a first open end 2 with a threaded outer diameter 8 and an annular flange 6 and a second open end 4. The clamp body 1 also includes at least two apertures 3 through the clamp body 1 and an annular flange 6 to secure the clamp body 1 against a fascia 30. The fascia may be a single wall or include multiple sides of the entire frame of a lighting tube display housing. It should also be understood that the various embodiments and implementations disclosed herein are particularly useful for non-linear lighting tubes of the type that are typically used for gas-tube lighting sign designs. Linear lighting tubes are predictable because their lengths and electrode ends are predictable. Non-linear lighting tubes, however, because the manufacturing process is different, are much more difficult to manufacture with exactly aligned electrodes and exacting lengths. The clamp body 1 may also include at least two angular flanges 5 at an end of the clamp body 1.

A lighting tube 60 with an electrode end 61 is inserted through a nut 40, one or more washers 41, a fascia or other lighting housing surface 30 and a tubular sleeve 25. The electrode end 61 with the tubular sleeve 25 is surrounded by at least one pressure arc 20 that each include at least one protrusion 20*a* on the outside surface of the at least one pressure arc 20. The lighting tube electrode end 61 combined with the elements of the tubular sleeve 25 and the pressure arcs 20 fits within the clamp body 1 such that the protrusions 20*a* of the pressure arcs 20 are inserted through the holes or openings 3 of the clamp body 1. The clamp body 1 with the pressure arcs 20, and one electrode end 61 of the lighting tube 60, and the tubular sleeve 25, combine to form one embodiment of a clamp body assembly 70 (FIG. 2).

The clamp body assembly 70 is inserted into the second end 11 of a clamp ring 10 when the protrusions 20*a* of pressure arcs 20 are aligned with and slid into entry grooves 13 (FIG. 4) of clamp ring 10. A clamp body 1 with angular flanges 5 also may align with flange grooves 15 (FIG. 4) of clamp ring 10 as protrusions 20*a* slide to the end of entry grooves 13. Clamp ring 10 may then be rotated such that protrusions 20*a* and angular flanges 5 slide around the inner circumference of clamp ring 10 within pressure grooves 14 and flange grooves 15 respectively. The rotation of clamp ring 10 around clamp body assembly 70 may increase pressure on protrusions 20*a* as the protrusions 20*a* are slid within pressure grooves 14 that are sloped toward its longitudinal axis 62 (FIGS. 3A and 3B), closer to the inner diameter 16 of clamp ring 10. The pressure arcs 20 are subsequently pushed closer together compressing tubular sleeve 25 and tightening the clamp body assembly's 70 hold on the electrode end 61 of the lighting tube 60.

Figure 6:
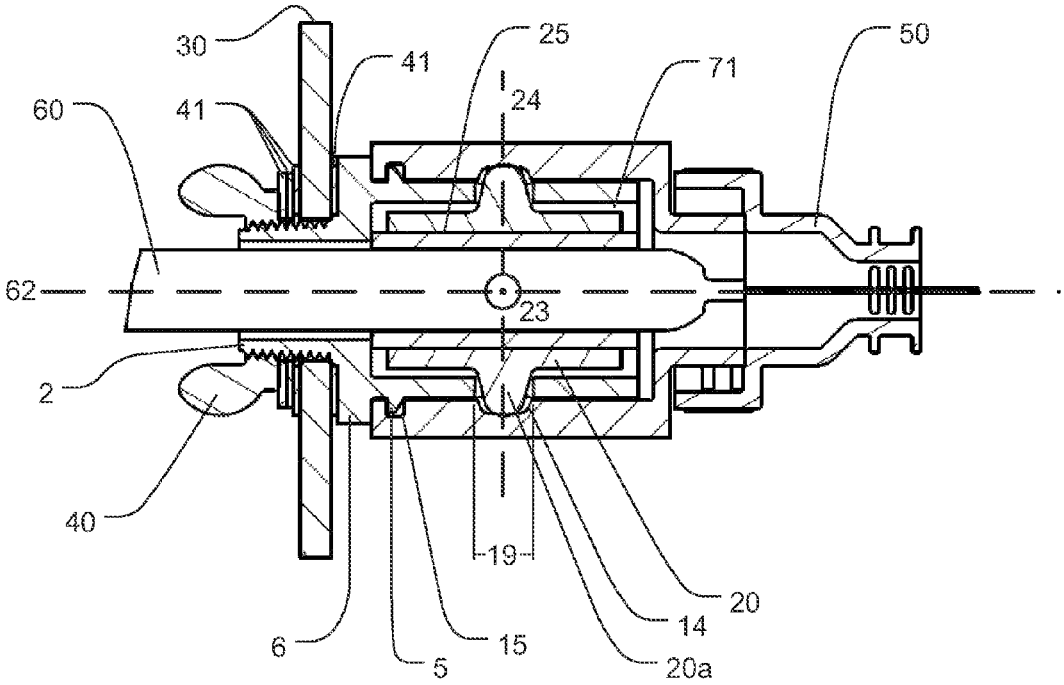
FIG. 6 depicts a cross sectional view of an assembled lighting tube fitting.

After the clamp ring 10 is rotated to a position that secures the clamp body 1 inside clamp ring 10, the threaded first opening end 2 of clamp body 1 is inserted through a fascia 30, until annular flange 6 is flush with the surface of fascia 30. The fascia 30 may merely be a substrate of wood, plastic, wallboard or metal, or may be part of some larger lighting housing. Nut 40 is tightened around the threaded first end 2 of clamp body 1 such that washers 41 are tightened against one side of the fascia 30 and the annular flange 6 or a washer 41 and an annular flange 6 is tightened against the other side of fascia 30. The first end opening 12 of clamp ring 10 may be attached to an electrode strain relief device 50. Strain relief device 50 is not a required component of the lighting tube fitting in all embodiments and other coverings are contemplated as well. The electrode strain relief device 50 may be coupled to the outside of the clamp ring 10 as shown, or may alternatively be coupled to the inside of the clamp ring 10. In particular implementations, the strain relief device 50 is weather resistant or moisture resistant to protect the electrodes extending from the lighting tube 60. Weather resistant and moisture resistant strain relief devices 50 may be made, for example, of plastic, rubber, neoprene, silicon, or other resilient, water resistant material. As illustrated in FIG. 6, the strain relief device 50 in many implementations includes a chamber within the strain relief device 50 within which other insulated electrical conductors may be coupled to the bare electrodes extending from the lighting tube 60. This in combination with a weather or moisture resistant strain relief device 50 helps to enable the couple to be used outdoors more safely.

Figure 2:
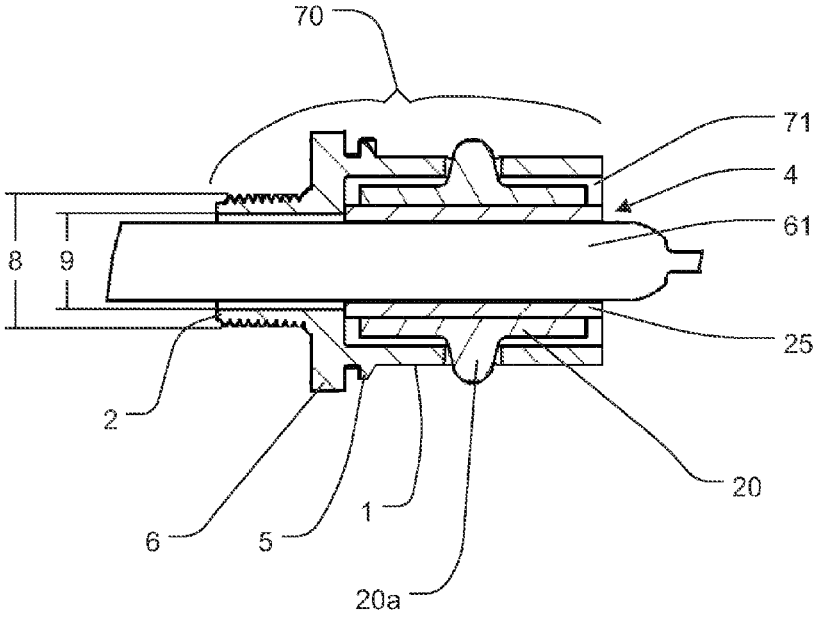
FIG. 2 depicts a cross sectional view of a clamp body assembly including the clamp body with the pressure arcs, tubular sleeve and a lighting tube inserted therein.
Figure 3A:
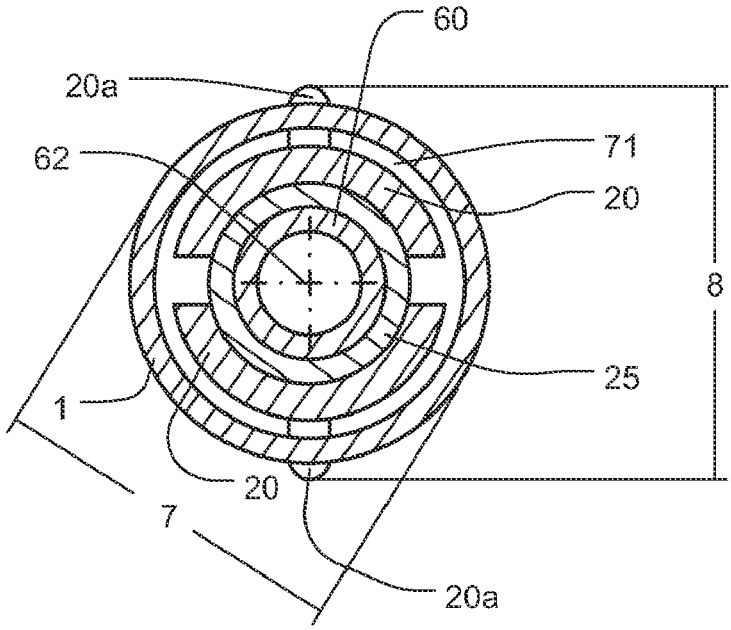
FIGS. 3A and 3B depict a back side cross sectional view of two implementations of the clamp body assembly
Figure 3B:
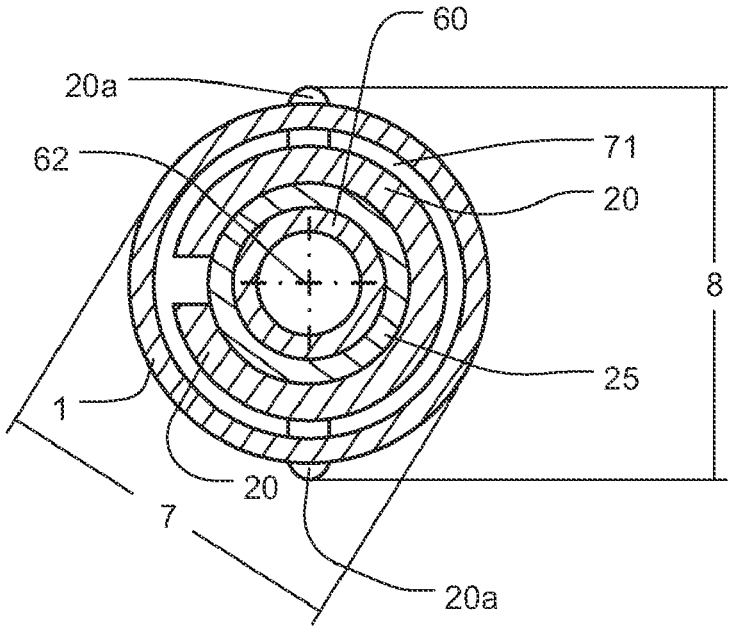

FIG. 2 illustrates a cross sectional of the clamp body assembly 70 including a clearance 71 between the convex outer wall of pressure arc 20 and the concave inner wall of clamp body 1. The clearance 71 of clamp body assembly 70 should be substantially equidistant at all diametric points between the outer surface of pressure arc 20 and the inner surface of clamp body 1. Protrusions 20*a* may be rounded or may be of another specific geometric shape to allow for radial movement of the pressure arcs 20 within pressure grooves 14. The protrusions 20*a* may be compressible with respect to the pressure arcs 20 and may or may not be fixed on the outer body of the pressure arcs 20. Compressible protrusions 20*a*, for example, may be formed of a compressible material such as a substantially rigid foam or other material that may compress slightly FIGS. 3A and 3B depict a cross sectional view of the clamp body assembly 70 perpendicular to the lighting tube longitudinal axis 62. FIG. 3A shows clamp body 1 housing two pressure arcs 20, a tubular sleeve 25 and lighting tube 60. Pressure arcs 20 are held within the clamp body 1 by the protrusions 20*a* on the pressure arcs 20 inserted through openings 3 of the clamp body 1. FIG. 3B shows a clamp body 1 housing an implementation of a single pressure arc 20*a*, a tubular sleeve 25 and lighting tube 60. It will be understood that the number of pressure arcs 20 in FIGS. 3A and 3B are not limitations on the scope or design of the disclosure and that one or more pressure arcs 20 may be used. In the example of FIG. 3B, where only a single pressure arc 20 is used that surrounds a majority of the lighting tube 60, the at least one pressure arc 20 still includes at least two protrusions 20*a* extending from an outer surface of the pressure arc 20. Where only a single pressure arc 20 is used, the single pressure arc 20 is formed of a flexible material, such as a plastic, that permits the pressure arc 20 to flex like a clamp to squeeze against the lighting tube 60 when pressure is applied to the at least two protrusions 20*a*. It will be understood from this disclosure that although in the particular implementation illustrated in FIG. 2 the at least two protrusions 20*a* are illustrated directly across from each other, other implementations may not include the protrusions 20*a* positioned symmetrically about the circumference of the tube 60. In another particular implementation it is contemplated that at least three pressure arcs 20 may be used, each with its own at least one protrusion 20*a*.

Figure 4:
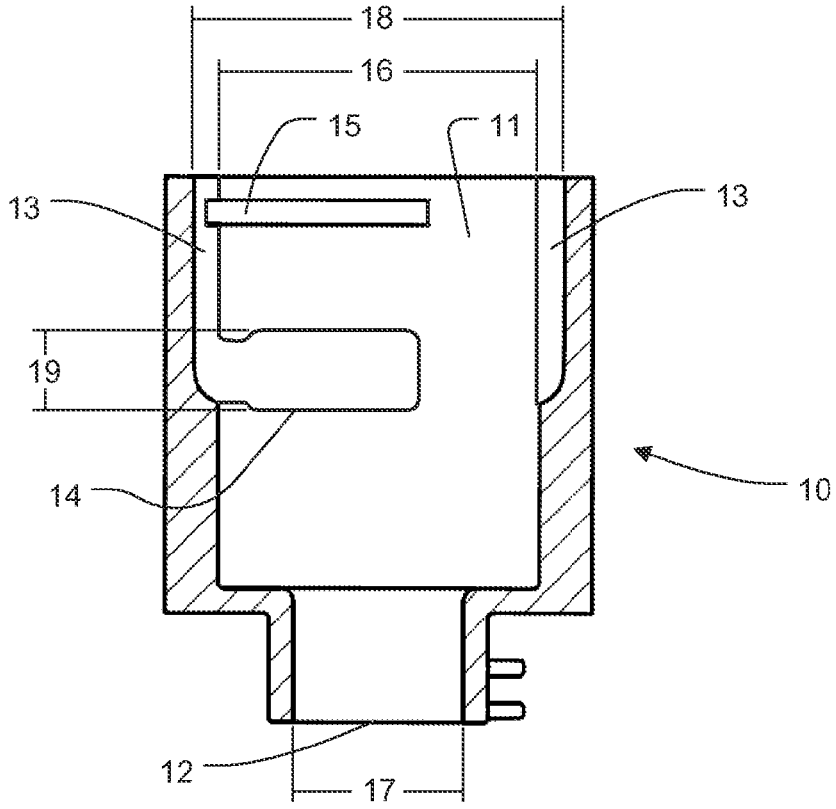
FIG. 4 depicts a cross section of a clamp ring

FIG. 4 depicts an implementation of a cross sectional view of the clamp ring 10 with two open ends including a first end opening 12 with an inner diameter 17 larger than a standard or custom lighting tube and a second end opening 11 with an inner diameter 16 larger than the outer diameter 7 of clamp body 1. Standard lighting tubes of the type relative to this disclosure come in sizes ranging from approximately 8 mm to approximately 25 mm in diameter, non-standard tubes will be close to that size, for example, ranging from approximately 5 mm to approximately 40 mm in diameter. Those of ordinary skill in the art will readily be able to adjust the relative dimensions of the components in this disclosure to adapt to specific tube diameters given the description provided here. Furthermore, it will be understood that particular component dimensions may be usable for a range of tube diameters because the use of the at least one pressure arc does not need to exactly fit each tube diameter to work properly. Because the at least two protrusions being compressed by the clamp ring 10 cause the at least one pressure arc 20 to apply pressure to the tube 60, the fit does not need to be exact to prevent longitudinal rotation of the tube within the at least one pressure arc 20. The clamp ring 10 may include two entry grooves 13 beginning at the edge and on the inside of the second opening 11 and continuing a distance parallel to the longitudinal axis 62 of the clamp ring 10 for a partial length. The entry grooves 13 allow the second end 4 of the clamp body assembly 70 to slide into the second end 11 of the clamp ring when the protrusions 20*a* of pressure arcs 20 align with and slide along the length of the entry grooves 13.

The clamp ring 10 may also include pressure grooves 14 that are connected to the entry grooves 13 and extend for a distance around the inner circumference of the second opening 11. The pressure grooves 14 may also slope towards the inner diameter 16 of the second end 11 of the clamp ring 10 from an initial depth equal to that of the depth of the entry grooves 13 to another reduced target depth. Including a slope on the pressure grooves 14 increases a force that presses the pressure arcs 20*a* towards the lighting tube 60 as the clamp ring 10 is rotated around the clamp body assembly 70 and the protrusions 20*a* of pressure arcs 20 slide within pressure grooves 14 around the inner circumference of clamp ring 10.

The pressure grooves 14 are of a sufficient width 19 that small movements of the protrusions within the grooves are possible in a direction other than about the longitudinal axis 62 of the clamp ring 10. In particular implementations, it is contemplated that each end of a lighting tube 60 may individually have up to 5 degrees of radial movement from its longitudinal axis in directions other than about its longitudinal axis in relation to the clamp body 1 to allow for variations in tubes during a tube mounting process while still supporting the entire weight of the tube by only its ends. Once both ends of the tube are secured in respective ends, Clamp ring 10 may also include flange grooves 15 on the inner circumference of the second opening 11 that allow flanges 5 on the outer circumference of the clamp body 1 to slide within the clamp ring 10. The flange grooves 15 may include a groove wall that is angled with respect to the other groove wall. These grooves 15, including an angled wall, would provide additional pressure and surface contact with flanges 5 between the clamp body 1 and the clamp ring 10 to further resist movement of the clamp body 1 with respect to the clamp ring 10 when securing the two together.

Figure 5:
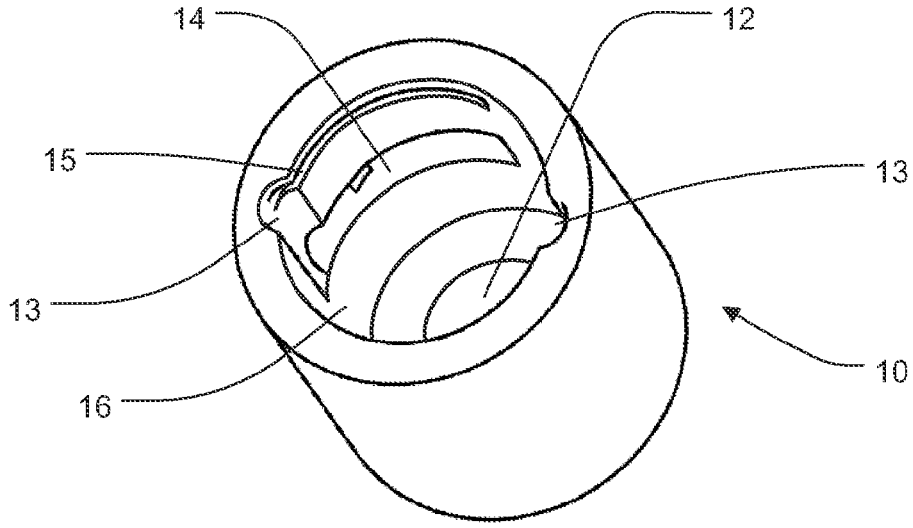
FIG. 5 depicts an oblique view of the clamp ring

FIG. 5 depicts an oblique view of the clamp ring 10 including entry grooves 13, pressure grooves 14 and flange grooves 15. Second end opening 12 of clamp ring 10 allows the electrode end 61 of lighting tube 60 to connect to a power source and first end opening 11 has a large enough diameter to allow the second end 4 of the clamp body assembly 70 to be received into clamp ring 10.

FIG. 6 depicts a cross section of the entire lighting tube fitting from FIG. 1, including a lighting tube 60 held within a clamp body assembly 70 (FIG. 2) with the first threaded end 2 of the clamp body 1 inserted through a fascia 30 and secured by a fastener such as a nut 40 and washers 41 on one side of the fascia 30 and the annular flange 6 of the clamp body 1 on the other side of the fascia 30. Longitudinal axis 62, horizontal through the electrode end of the lighting tube 60, and axis 24 represented vertically through the center point of protrusions 20*a* intersect at a point on a third axis 23 that goes into the page and is perpendicular to both axes 62 and 24. The pressure arcs 20 hold the lighting tube 60 with friction layer 25, which in the particular implementation of FIGS. 1-6 is illustrated as a tubular sleeve 25. Although the friction layer 25 is illustrated as a tubular sleeve 25 that surrounds the tube 60 in this particular example, it should be understood that the friction layer 25 may alternatively be merely a layer of friction material between the at least one pressure arc 20 or adhered to the at least one pressure arc 20. Not all implementations will necessarily include a friction layer 25. The pressure grooves 14 of clamp ring 10 secure protrusions 20*a* and prevent the lighting tube 60 from rotating about axis 62. However, the lighting tube70 is free to rotate a few degrees both about axis 24 in a left to right direction as well as about axis 23 in an up and down direction.

Various inserts and stress relief covers 50 may be utilized to protect and/or ensure that the wires extending from the lighting tube 60 are supported when they are connected to any of a wide variety of connecting cable types, such as, by non-limiting example, GTO, Neo-Pro, High Voltage (HV) silicone, and any other cable or wire type. In the particular implementation illustrated in FIG. 6, a stress relief cover 50 is included around the end of the clamp ring 10.

In other particular implementations, a larger variety of sizes of lighting tubes 60 may be utilized with the same sized clamp body 1 and clamp ring 10 merely by changing the size of the pressure arcs 20 and/or the thickness of the friction layer 25 to match a particular tube diameter. This may allow the clamp body 1 and clamp ring 10 to serve as fairly universal parts while a user can use a specific pressure arc 20 and friction material 25 for particular sized tubing.

Any of a wide variety of features and structures may be employed with various implementations of tube fittings, using the principles disclosed in this document. The various Figures outlining a wide variety of options, structures, and assembly techniques may be employed in particular implementations. These examples are for the exemplary purposes of this disclosure and are non-limiting. For example, various systems and features exist for locking the position of a clamp ring 10 in place when a desired tightness has been reached. Various other designs for the clamp body 1, clamp ring 10, pressure arc 20, and other parts of the tube fitting also exist. Using the principles disclosed in this document, a wide variety of implementations are possible.

Implementations of lighting tube fittings like those disclosed in this document may have many advantages over the current state-of-the-art. An example of an advantage is that lighting tubes connected to a sign using tube fittings, similar to those disclosed, may be held such that substantially no movement of the tube may occur once two fittings are used on both ends of the lighting tube, but adjustment of the position of the tube is still possible in non-axial directions when only one tube fitting is secured to one end of a lighting tube. A second example is that the need for high precision forming of tubes and the need for tube supports in the middle of a sign may be obviated through use of the disclosed tube fittings because the entire lighting tube can be supported at both ends by the disclosed tube fittings. This allows the use of non-planar lighting tube designs that extend from the plane of the sign without requiring tube supports in the middle of their extents. These examples are not the only advantages of the disclosed tube fittings and not all implementations have each of these advantages. Other advantages of the various implementations are not limited by those discussed here.

The materials used for implementations of lighting tube fittings may be made of a wide variety of conventional materials used to make goods similar to these in the art, such as, by non-limiting example, metals, plastics, rubbers, composites, ceramics, and the like. Those of ordinary skill in the art will readily be able to select appropriate materials having appropriate dielectric, ultraviolet (UV) resistance, heat resistance, and/or flame resistance properties and manufacture these products from the disclosures provided herein.

The implementations listed here, and many others, will become readily apparent from this disclosure. From this, those of ordinary skill in the art will readily understand the versatility with which this disclosure may be applied.

The invention claimed is:

1. A lighting tube fitting assembly for a non-linear lighting tube, the fitting assembly comprising:

a clamp body comprising at least one side wall comprising openings at first and second ends, the at least one side wall comprising at least two apertures there through;

at least one pressure arc comprising a concave inner surface and an outer surface opposing the concave inner surface, the outer surface comprising at least two protrusions each sized small enough to extend through one of the at least two apertures through the at least one side wall of the clamp body;

a clamp ring comprising a side wall having an inner surface comprising an inner diameter large enough to receive therein at least one of the first end and the second end of the clamp body;

wherein when assembled with a lighting tube, each of the at least one pressure arcs is pressed toward the lighting tube by the respective at least two protrusions each extending through one of the at least two apertures through the at least one side wall of the clamp body, the at least two protrusions exerting a force against the inner surface of the clamp ring.

2. The lighting tube fitting of claim 1, wherein the inner surface of the clamp ring comprises at least two grooves each arranged to receive one of the at least two protrusions, and permit rotation of the clamp ring with respect to the clamp body while a portion of each of the at least two protrusions extends into one of each of the at least two grooves.

3. The lighting tube fitting of claim 2, wherein a first of the at least two grooves on the inner surface of the clamp ring comprises a sloped surface within the first groove sloping to give a diminishing depth of the first groove.

4. The lighting tube fitting of claim 2, the inner surface of the clamp ring further comprising at least one additional groove positioned to align with at least one angled flange extending from the at least one side wall of the clamp body.

5. The lighting tube fitting of claim 4, wherein the at least one additional groove comprises at least a first groove side wall angled with respect to at least a second side wall of the at least one additional groove.

6. The lighting tube fitting of claim 2, the at least two grooves each further comprising a width, wherein the width of each of the at least two grooves is wider than a width of its respective protrusion of the at least two protrusions exerting force against the inner surface of the clamp ring.

7. The lighting tube fitting of claim 1, wherein the at least one pressure arc comprises at least two pressure arcs and each of the at least two pressure arcs comprises at least one of the at least two protrusions, wherein each of the at least two protrusions is sized small enough to extend through one of the at least two apertures of the clamp body.

8. The lighting tube fitting of claim 1, further comprising a tubular sleeve adjacent to the concave inner surface of the at least one pressure arc.

9. The lighting tube fitting of claim 1, further comprising a coating material on the concave inner surface of the at least one pressure arc.

10. The lighting tube fitting of claim 1, wherein the outer surface of each of the at least one pressure arcs is convex.

11. The lighting tube fitting of claim 1, wherein the first end opening of the clamp body comprises a threaded outer diameter.

12. The lighting tube fitting of claim 1, wherein each of the at least two protrusions is rounded where it exerts the force against the inner surface of the clamp ring.

13. The lighting tube fitting of claim 1, wherein the at least one pressure arc comprises at least three pressure arcs and each of the at least three pressure arcs comprises at least one of the at least two protrusions, the at least two apertures through the at least one side wall of the clamp body comprising at least three apertures, wherein each of the at least three protrusions is sized small enough to extend through one of the at least three apertures of the clamp body.

14. The lighting tube fitting of claim 1, wherein at least one of the at least two protrusions is compressible with respect to the at least one pressure arc.

15. The lighting tube fitting of claim 1, wherein the opening at the first end of the clamp body comprises an inner diameter of at least six millimeters.

16. The lighting tube fitting of claim 1, further comprising a moisture resistant strain relief sleeve coupled to the clamp ring.

17. A method of securing and supporting a non-linear lighting tube comprising:

passing a first electrode end of a non-linear lighting tube through an aperture in a fascia;

placing a clamp body, comprising at least one pressure arc therein, around the non-linear lighting tube such that at least two protrusions extending from at least one surface of the at least one pressure arc extend through at least one side wall of the clamp body;

sliding a first end of the clamp body through the aperture in the fascia such that a majority of the clamp body is on a first side of the fascia and the first end of the clamp body extends through to a second side of the fascia opposing the first side;

sliding a clamp ring around a first end of the clamp body and engaging the clamp ring with the clamp body such that the clamp ring exerts a force against the at least two protrusions which exert a force against the non-linear lighting tube within the at least one pressure arc;

securing the first end of the clamp body to the fascia by coupling a fastener to the first end of the clamp body on the second side of the fascia.

18. The method of claim 17, wherein sliding the clamp ring around the first end of the clamp body further comprises sliding the clamp ring around the clamp body such that the at least two protrusions each align with at least one groove on an inner surface of the clamp ring.

19. The method of claim 17, wherein engaging the clamp ring with the clamp body comprises rotating the clamp ring with respect to the clamp body.

20. The method of claim 17, further comprising adjusting the lighting tube about at least one axis but not more than two axes after engaging the clamp ring with the clamp body and after securing the first end of the clamp body to the fascia.

21. The method of claim 20, further comprising securing a second electrode end of the non-linear lighting tube to the fascia after adjusting the non-linear lighting tube about the at least one axis.

22. A lighting tube display system comprising:

a non-linear lighting tube comprising a first electrode end comprising a longitudinal axis;

a display housing comprising a first electrode port; and a first lighting tube fitting adapted to secure the first electrode end of the lighting tube to the display housing at the first electrode port such that the first lighting tube fitting restricts the non-linear lighting tube from rotating about the longitudinal axis of the first electrode end but allows rotation of the non-linear lighting tube about a second axis perpendicular to the longitudinal axis.

23. The lighting tube display system of claim 22, wherein the first lighting tube fitting further secures the first electrode end of the lighting tube such that it allows the lighting tube to rotate about a third axis perpendicular to the first and the second axis.

24. The lighting tube display system of claim 23, wherein the rotation of the lighting tube about the second and third axes is limited to less than about 5 degrees.

25. The lighting tube display system of claim 22, further comprising a second lighting tube fitting securing a second electrode end of the non-linear lighting tube at a second electrode port of the display housing such that when both the first electrode end and the second electrode ends are secured to the display housing, the lighting tube is fixedly secured to the display housing such that the lighting tube is no longer able to rotate about any axis.

26. The lighting tube display system of claim 25, wherein the first and second lighting tube fittings at the respective first and second electrode ports of the display housing support the entire weight of the non-linear lighting tube.

* * * * *